US005360042A

United States Patent [19]

Teh

[11] Patent Number: 5,360,042

[45] Date of Patent: Nov. 1, 1994

[54] VENEER MANUFACTURING PROCESS

[76] Inventor: Tai Y. Teh, Lot 8028, Batu 4, Jalan, Mengkibol, 86000 Kluang, Johor, Malaysia

[21] Appl. No.: 94,464

[22] Filed: Jul. 20, 1993

[30] Foreign Application Priority Data

Nov. 27, 1992 [MY] Malaysia ..... PI 9202191

[51] Int. Cl.[5] ..... B27C 7/00; B27L 5/02

[52] U.S. Cl. ..... 144/365; 144/209.R; 144/212

[58] Field of Search ..... 144/209 R, 211, 212, 144/365

[56] References Cited

U.S. PATENT DOCUMENTS

| | | | |
|---|---|---|---|
| 854,256 | 5/1907 | Thornton | 144/212 |
| 945,690 | 1/1910 | Bush | 144/212 |
| 1,004,345 | 9/1911 | Baxter | 144/212 |
| 2,692,624 | 10/1954 | Sorenson | 144/212 |
| 4,239,071 | 12/1980 | Ritchie | 144/212 |
| 4,753,278 | 6/1988 | Lorenzo | 144/365 |

FOREIGN PATENT DOCUMENTS

| | | | |
|---|---|---|---|
| 661167 | 7/1929 | France | 144/365 |

OTHER PUBLICATIONS

Product catalog entitled "Series Machinery Single Spindle Veneer Lathes", China Xinyand Woodworking Machinery Plant, one page, published in the People's Republic of China.

*Primary Examiner*—W. Donald Bray

*Attorney, Agent, or Firm*—Merchant, Gould, Smith, Edell, Welter & Schmidt

[57] ABSTRACT

A veneer manufacturing process comprising placing a log within a work station, the work station having chucks at either end thereof for releasably engaging respectively ends of the log such that the log is rotatable about its longitudinal axis, and then rotating the log about its axis such that the rotating log may be brought into engagement with a blade system, The blade system extends along the entire length of the work station and engages the log during rotating thereof such that a thin continuous layer of timber of uniform thickness is cut therefrom as the log rotates, The blade system includes retractable end sections that may be retracted prior to the blade system striking the chuck, thus allowing a central blade section to continue engagement with the log to a diameter less than the diameter of the chucks.

8 Claims, 3 Drawing Sheets

VENEER MANUFACTURING PROCESS

FIELD OF INVENTION

This invention relates to a process for manufacturing veneers, particularly on a commercial scale for use in the manufacture of plywood or other products that utilize veneers.

A veneer is a thin layer of timber of uniform thickness that is often produced from fine grained timbers for decorative purposes, Indeed, veneers are often attached to other, cheaper timbers to create an appearance that the cheaper timbers are of the type of wood of the veneer.

Veneers are also commonly used in the manufacture of plywood which is a board consisting of a number of thin layers of wood ( in this case, the veneer) glued together so that the grain of each layer is at a right angle to its neighbour.

A traditional process for manufacturing veneers is a process similar to wood turning where a complete log is loaded between the chucks of a lathe-like machine so that the log may be rotated about its axis. A cutting blade is located along the full length of the machine, the cutting blade capable of being introduced to the log as it rotates to cut a thin layer of timber, usually in a continuous sheet from the surface of the log along its full length. This operation is sometimes referred to as 'shaving' the log.

However, this process is limited by the diameter of the chucks as to what diameter the log may be cut down to. In this respect, the logs utilized are generally very large and thus require large diameter chucks to be held securely in place. This then dictates that the size of the log remaining after the operation is reasonably significant and a large portion of the timber of the log is thus wasted.

An aim of the present is to provide a veneer manufacturing process that overcomes, or at least partly alleviates, this difficulty.

SUMMARY OF INVENTION

The present invention provides a veneer manufacturing process, said process comprising placing a log within a work station, the work station having chucks at either end thereof for releasably engaging respective ends of the log such that the log is rotatable about its longitudinal axis, and then rotating the log about its axis such that the rotating log may be brought into engagement with a blade system, the blade system extending along the entire length of the work station and engaging the log during rotation thereof, such that a thin continuous layer of timber of uniform thickness is cut therefrom as the log rotates, the blade system including retractable end sections that may be retracted prior to the blade system striking the chuck, thus allowing a central blade section to continue engagement with the log to a diameter less than the diameter of the chucks.

The present invention also provides apparatus for the veneer manufacturing process, the apparatus including a work station having chucks at either end thereof for releasably engaging the respective ends of a log such that the log is rotatable about its longitudinal axis, the apparatus also including a blade system located along the entire length of the work station, the blade system being adapted so as to be capable of movement into and out of engagement with the log when at the work station such that a thin continuous layer of timber of uniform thickness is cut therefrom as the log rotates, the blade system including retractable end sections that may be retracted prior to the blade system striking a chuck, thus allowing a central blade section to continue engagement with the log to a diameter less then the diameter of the chucks.

In a preferred form, the invention also includes a means for scoring the log about the circumference thereof between each retractable end section and the central blade section. The presence of such a scoring means assists in providing a smooth transition from the production of a veneer having the full length of the log to a veneer of the length of the center blade section only. Thus, as the retractable end sections are retracted, the scoring means may be brought into engagement at either end of the central blade section, creating shoulders at either end of the log between which the central blade section may operate to remove the thin layer of timber.

It will also be appreciated that the veneer will travel through the apparatus of the invention after being cut from the log to be passed to a veneer handling section where the veneer is preferably rolled in a continuous length so as to be ready for further processing as necessary.

BRIEF DESCRIPTION OF THE DRAWINGS

The present invention will now be described in relation to a preferred embodiment as illustrated in the accompanying drawings. However, it must be understood that the following description is not to limit the generality of the above description.

In the drawings.

DETAILED DESCRIPTION OF THE PREFERRED EMBODIMENT

Figure 1:
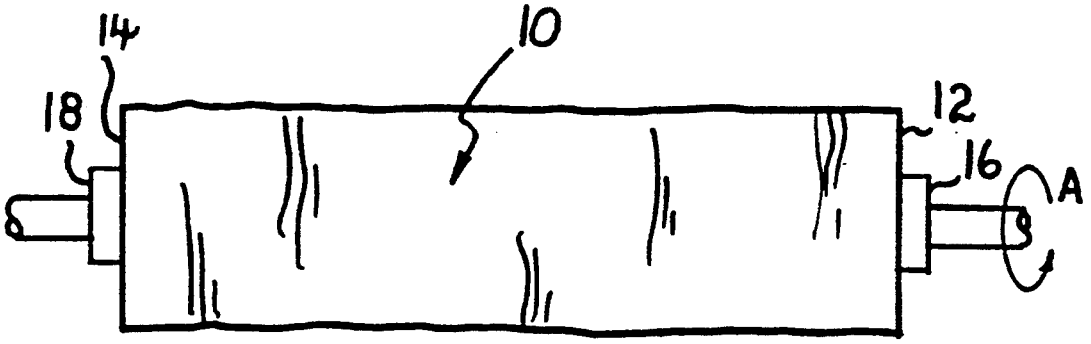
FIG. 1 is a front elevational view of a log as loaded in a conventional veneer manufacturing system.

Illustrated in FIG. 1 is the work station of a traditional veneer manufacturing process, Located within the work station is a log 10 that has been felled and remains in an untreated form with the exception of the freshly cut ends 12 and 14.

Each of the ends 12 and 14 of the log 10 are held in place by chucks 16 and 18 within the working station, Thus, the apparatus of the veneer manufacturing process may be able to rotate the log 10 about its longitudinal axis as indicated by arrow A.

Figure 2:
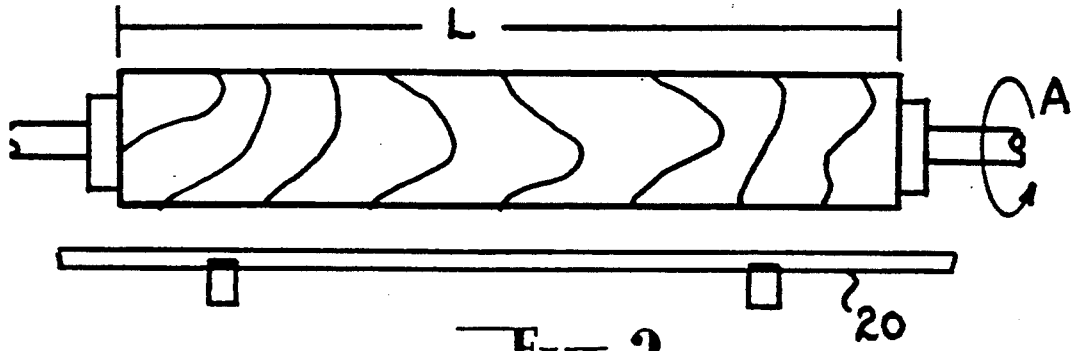
FIG. 2 is a front elevational view of the log of FIG. 1 after the process has been completed.

In the traditional veneer manufacturing process as illustrated in FIG. 1, a blade 20 (as illustrated in FIG. 2) is introduced along the entire length L of the log 10 as the log rotates, to engage the log and cut 10 therefrom a thin layer of timber of uniform thickness in continuous sheets. Thus, the log 10 is 'shaved' until it reaches a diameter that approximates the diameter shown schematically in FIG. 2.

Due to the blade 20 being of a length that overlaps beyond the length of the log, passing the chucks 16 and 18, the operation must be discontinued once the diameter of the log approaches that of the chucks, Therefore, when chucks having a diameter of, for example, twenty centimeters (20 cm) need to be utilized in order to support a log of particular weight, the diameter of the log that would remain after the operation has been forced to be completed would be in the order of, for example, twenty five centimeters (25 cm) or more, There is thus a significant volume of timber that is wasted.

It will be appreciated that though chucks 16 and 18 may be replaced with chucks of smaller diameter to further "shave" the remaining log 10, the operation has to be discontinued when changing the chucks 16 and 18 and is cumbersome.

It will also be appreciated that due to the differing lengths of logs that are utilized in such processes, it has not been possible to simply provide a shorter length blade. This would cause difficulties in removing the outer rough layer of the timber, and also in providing an acceptably neat edge for the veneer produced.

Figure 3:
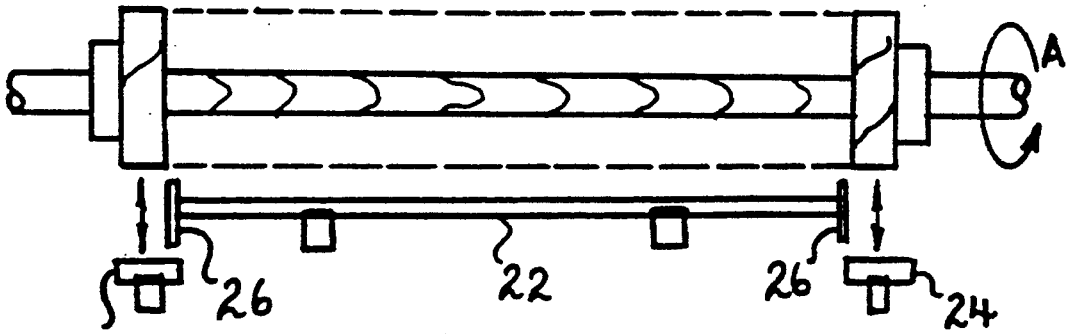
FIG. 3 is a front elevational view of the log of FIGS. 1 and 2 after further processing by the veneer manufacturing process according to the preferred embodiment of the present invention.

Therefore, the present invention preferably includes a blade system as illustrated in FIG. 3, The blade system utilizes a central blade section 22 and retractable end sections 24 located at either end thereof. The blade system also includes scoring means 26 in association with each end of the central blade section 22.

In this form, the central blade section 22 and the two retractable end sections 24 may be arranged as one single length during operation of the veneer manufacturing process on a log from the state indicated generally by FIG. 1 to the state indicated generally by FIG. 2. However, once the diameter of the log has been reduced to a point close to the diameter of the chucks, the retractable end sections may be retracted and the scoring means 26 may be introduced, so as to continue the operation to reduce the diameter of the log to a diameter significantly less than the diameter of the chucks.

It can thus be seen that a far greater volume of the log may be utilized for producing veneers according to this manufacturing process, and the ends of the veneer as produced after the retractable end sections are retracted are cleanly cut as provided by the scoring means.

In this embodiment, it will be appreciated that the length of the central blade section 22 may be of a length that is certain to be within the absolute length of each of the logs that are likely to be used in the process. Thus, even i f the logs generated are a great deal longer than the central blade section 22, the only significant amount of loss will be during that portion of the operation where the retractable end sections are ratracted.

Figure 4:
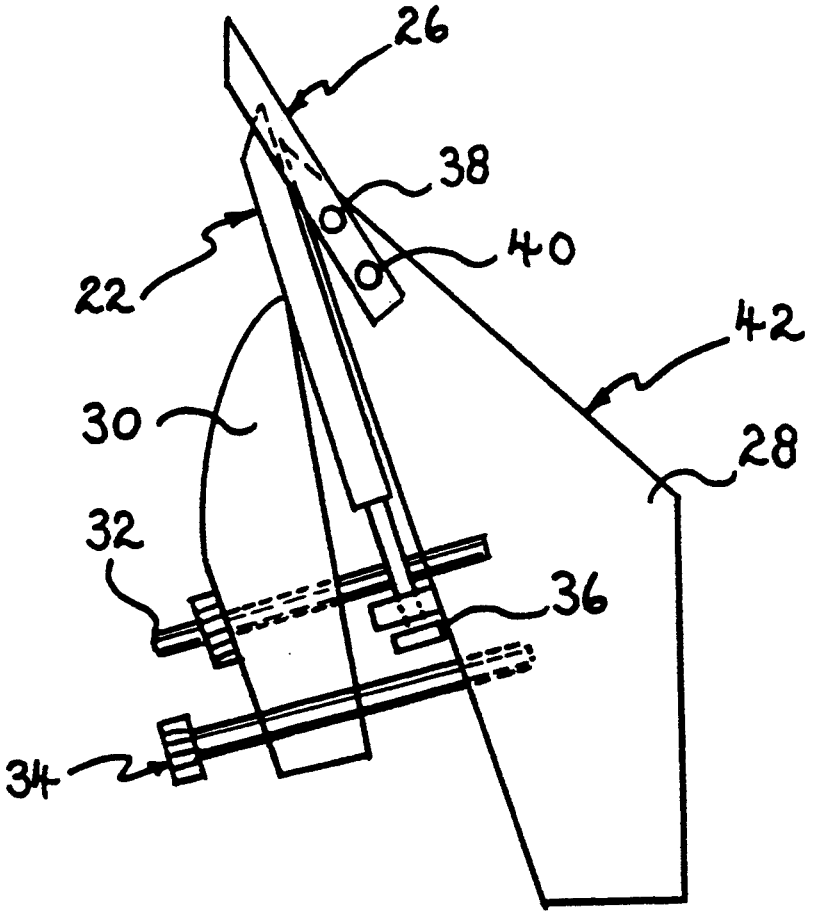
FIG. 4 is an end view of the central blade section of the embodiment of FIG. 3.
Figure 5:
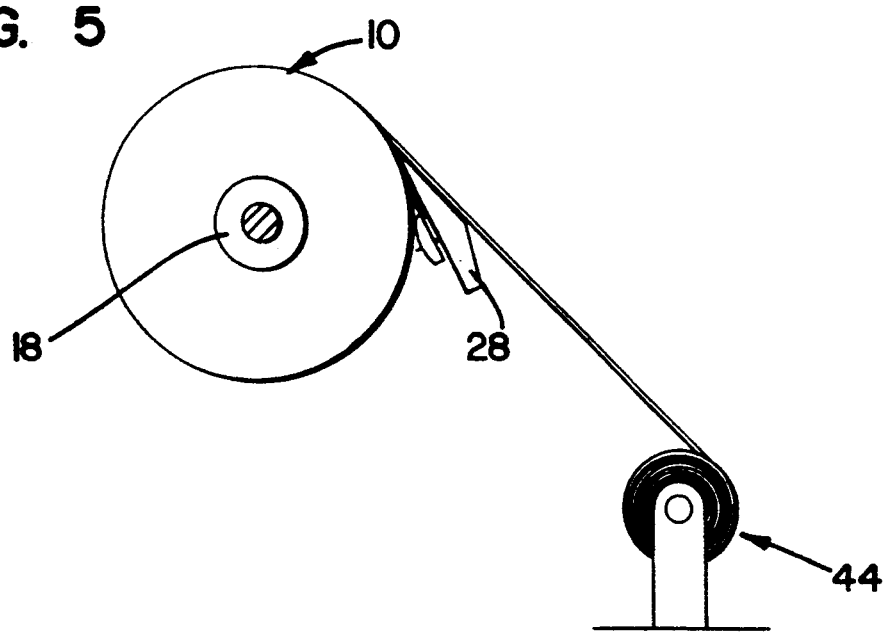
FIG. 5 is a side view of the veneer manufacturing system according to the embodiment shown in FIG. 3 which includes a veneer handling section.

An example of the type of clamping arrangement that may be possible for the central blade section 22 of the embodiment illustrated in FIG. 3 is illustrated in FIG. 4. In this drawing there is provided a body 28 having a clamping member 30 adjustably secured thereto by screws 32 and 34, for securing therebetween the central blade section 22. The central blade section 22 may also be adjusted for its extension beyond the body 28 by virtue of adjustable screw member 36.

A scoring means 26 may be provided in the form of a minor blade adjustably secured at the top end of the body 28 by way of screw members 38 and 40. The scoring means 26 is preferably configured so as to be capable of being brought into and out of engagement with the log at a predetermined time during the operation of the process. This predetermined time is preferably that time at which the retractable end sections 24 (as illustrated in FIG. 3) are retracted.

It will also be appreciated that as the central blade section 22 cuts through the surface of the rotating log 10 (not shown) the thin layer of timber that is 'shaved' therefrom passes over the top inclined surface 42 of the body 28 to be passed to the rear of the apparatus and preferably to be collected on a veneer handling section 44 for storage and further treatment if necessary.

Finally, it will be appreciated that there may be other alterations and modifications to the configurations described above that are also within the scope of the present invention.

I claim:

1. A veneer manufacturing process, comprising the steps of:

engaging each end of a log with a chuck, the chuck being proportionally smaller than the diameter of the log;

rotating the log about its longitudinal axis;

bringing a blade system into engagement with the rotating log such that a continuous sheet of veneer is cut from the log, the blade system having retractable end sections and a central blade section combining to form a blade having a length greater than the entire length of the log such that the sheet of veneer is as wide as the entire length of the log;

retracting the end sections of the blade system prior to the blade system striking the chucks; and continuing engagement of the central blade section with the rotating log such that a narrower continuous sheet of veneer is removed from a central portion of the log between the chucks.

2. A veneer manufacturing process according to claim 1, the process including the steps of:

bringing scoring means into engagement with the log at each end of the central blade section upon retraction of the end sections, the scoring means engaging the log in advance of the central blade section; and cutting the surface of the rotating log about the circumference thereof with the scoring means to facilitate removal of the narrower continuous sheet of veneer by the central blade section.

3. A veneer manufacturing process according to claim 1, the process further including the steps of feeding the continuous sheet of veneer as it travels from the blade system after being cut from the log to a veneer handling section, and rolling the sheet of veneer in a continuous length onto the veneer handling section so as to be ready for further processing as necessary.

4. A veneer manufacturing process according to claim 2, the process further including the steps of feeding the continuous sheet of veneer as it travels from the blade system after being cut from the log to a veneer handling section, and rolling the sheet of veneer in a continuous length onto the veneer handling section so as to be ready for further processing as necessary.

5. An apparatus for a veneer manufacturing process, the apparatus comprising a work station having chucks at either end thereof for releasably engaging the ends of a log, each chuck being proportionally smaller than the diameter of the log, means for rotating the log about its longitudinal axis, a blade system having a length greater than the entire length of the log, means for moving the blade system into and out of engagement with the rotating log such that a thin continuous sheet of veneer of uniform thickness and having a width equal to the length of the log is cut therefrom, the blade system including retractable end sections and a central blade portion having a length less than the distance between the chucks, and means for retracting the end sections prior to the blade system striking a chuck, and whereby the central blade section may continue engagement with the rotating log such that a narrower continuous sheet of veneer may be removed from a central portion of the log between the chucks.

6. An apparatus according to claim 5 including a means for scoring the surface of the rotating log about the circumference thereof between each retractable end section and the central blade section upon retraction of the end sections.

7. An apparatus according to claim 5 wherein the scoring means includes a blade that is adjustably and retractably secured adjacent to each of the ends of the central blade section and which projects in advance of the central blade section so as to be capable of scoring the surface of the rotating log when the retractable end sections are retracted.

8. An apparatus according to claim 6 wherein the scoring means includes a blade that is adjustably and retractably secured adjacent to each of the ends of the central blade section and which projects in advance of the central blade section so as to be capable of scoring the surface of the rotating log when the retractable end sections are retracted.

* * * * *